US005396952A

United States Patent [19]

Stogner

[11] Patent Number: 5,396,952

[45] Date of Patent: Mar. 14, 1995

[54] DRILLING RIG KELLY SPINNER

[76] Inventor: Huey Stogner, P.O. Box 803, Houston, Tex. 77001

[21] Appl. No.: 139,415

[22] Filed: Oct. 20, 1993

[51] Int. Cl.[6] ..... E21B 3/00

[52] U.S. Cl. ..... 166/78; 175/195

[58] Field of Search ..... 166/78, 75.1, 77.5; 175/162, 195

[56] References Cited

U.S. PATENT DOCUMENTS

| | | | |
|---|---|---|---|
| 2,689,139 | 9/1954 | Jones et al. | 285/22 |
| 3,513,665 | 5/1970 | Crickmer | 64/23.5 |
| 3,598,188 | 8/1971 | Foster | 175/195 X |
| 4,325,233 | 4/1982 | Haynes | 64/23.5 |
| 4,448,255 | 5/1984 | Shaffer et al. | 166/387 |
| 4,630,688 | 12/1986 | True et al. | 166/78 X |
| 4,683,962 | 8/1987 | True | 173/163 |
| 5,031,695 | 7/1991 | Cain et al. | 166/75.1 |
| 5,036,927 | 8/1991 | Willis | 175/162 |
| 5,062,490 | 11/1991 | Rassieur | 175/195 X |
| 5,224,557 | 7/1993 | Yewuus et al. | 175/195 |

OTHER PUBLICATIONS

Kelly Spinner Assembly and Installation Literature and Drawings, International Tool Company, Inc., Three (3) pages, 1962–1967.

*Primary Examiner*—Michael Powell Buiz

*Attorney, Agent, or Firm*—Daniel N. Lundeen; Andrew S. Pryzant

[57] ABSTRACT

A kelly spinner for a drilling rig and installation method are disclosed. The spinner is installed directly to a stem of the derrick swivel by means of an adjustable sleeve which fits around the swivel stem. A clamping device is tightened to secure the sleeve to the stem and the clamp to the sleeve. A ring gear bolted to the clamp body is rotated by dual hydraulic or pneumatic motors to rotate the spinner.

12 Claims, 2 Drawing Sheets

DRILLING RIG KELLY SPINNER

FIELD OF THE INVENTION

The present invention relates to a kelly spinner for making up a joint of drill pipe in an oil well drilling operation.

BACKGROUND OF THE INVENTION

A kelly spinner is a well known tool for making up a joint of drill pipe by application of a fixed amount of torque. Use of a kelly spinner can significantly reduce the time required for the joint makeup operation and the potential of spark formation and lost fingers in comparison to spinning chains previously employed.

Kelly spinners typically comprise a geared mandrel having suitable pipe connections at each end. The mandrel is installed in the string between a derrick swivel and a kelly joint. A motor then turns the mandrel which in turn spins the kelly joint to makeup a new joint on the kelly opposite end.

In some circumstances, it is not desirable to insert the spinner mandrel in the drill string due to space limitations. In such instances, the spinner mandrel can be removed and the ring gear of the spinner is attached directly to a swivel stem. In one commercial version, the ring gear was secured to a collar which fit around the swivel stem. The collar was held in place by a plurality of radially spaced set screws threaded transversely through the collar to engage the swivel stem in coaxial alignment. Such screws have proved inadequate for preventing axial play along the swivel stem because the spinner gear was difficult to install without radial misalignment. Even with proper alignment during installation, the set screws were axially offset from the ring gear and could not maintain good alignment during operation. Run-out in the gear usually resulted in an eventual loosening of the screws. Axial play often caused the spinner gear to slip along the stem and disengage from an intermeshing motor pinion gear.

Consequently, there is a need in the art for a means for attaching the spinner gear to the swivel stem which ensures radial alignment to the swivel stem and avoids play in the axial direction.

SUMMARY OF THE INVENTION

A kelly spinner ring gear can be attached to the stem of an oil derrick swivel by compression of an adjustable sleeve. In such a manner, axial play in the ring gear can be minimized.

In one embodiment, the present invention provides a kelly spinner for making up and breaking out a joint of drill pipe in an oil well drilling operation. The spinner comprises a cylindrical housing having a central opening. An adjustable sleeve concentric with the central opening is provided for receiving a stem of a derrick swivel. The sleeve has an outer diameter surface and preferably includes axial stop pins affixed thereto. A clamp made up of a hub member and an associated flange member is provided for locking the sleeve to the swivel stem. The clamp is disposed adjacent the sleeve pins and outer diameter surface forming a radial slot therebetween. A cylindrical locking ring assembly is disposed in the radial slot. The locking ring assembly includes dual axially split members having complementary angled axial surfaces. A ring gear is fixedly attached to the clamp. A motor mounted in the housing is in rotational engagement with the ring gear.

In a preferred embodiment, the spinner includes a plurality of radially spaced gauge members. The gauge members have an upper shoulder at an inside end for aligning the ring gear to the swivel stem. The housing includes an upper flange plate for attachment to the derrick swivel. The motor is mounted to the housing at a lower flange plate. Dual motors are provided for dual directional rotation. The ring gear is preferably a split gear ring assembly.

In another embodiment, the present invention provides a method for installing a kelly spinner on a swivel stem connected to a sub. The stem is disconnected from the sub. A sleeve is slid up the stem. The sleeve has an inside diameter slightly larger than an outside diameter of the stem, a longitudinal gap to allow radial compression to reduce the inside diameter of the sleeve to the outside diameter of the stem, and a plurality of axial stops on an outside diameter of the sleeve adjacent an upper end thereof. The sub is reconnected to the stem. A ring gear assembly is positioned on a housing with a plurality of radially spaced gauges removably affixed to the housing. The gauges have inner and outer ends with the inner end including an upper shoulder with an annular surface for axially positioning a lower end of the ring gear resting thereon and a longitudinal surface extending upwardly from the annular surface for radially positioning an outside diameter of teeth on the ring gear. The gauge outer end is adapted for securing the gauge body in a predetermined position with respect to the housing. The ring gear is circumferentially mounted on an annular clamp assembly. The annular clamp assembly comprises a hub member, an associated flange member and a locking ring assembly. The locking ring assembly comprising dual axially-split ring members having complementary angled oblique surfaces is disposed in an annular slot. The housing is raised to the swivel with the ring gear positioned thereon to slide over the sub and loosely receive the sleeve in the annular clamp assembly. The housing is secured to the swivel in positionally fixed relation thereto in alignment with the swivel stem with the stops on the sleeve in abutment with an upper end of the clamp assembly. The locking ring assembly is substantially evenly compressed axially between the hub member and the flange member to radially compress the sleeve to lock the sleeve into tight engagement with the stem while maintaining the positioning of the ring gear relative to the housing The gauges are removed. Drive gears are positioned in engagement with the ring gear for rotation of the spinner.

DETAILED DESCRIPTION OF THE INVENTION

A kelly spinner of the present invention can be installed directly to the swivel stem rather than between the swivel and kelly to obviate space limitations in smaller rigs. In addition, use of a compression fitting facilitates radial alignment and minimizes axial play along the stem.

Figure 1:
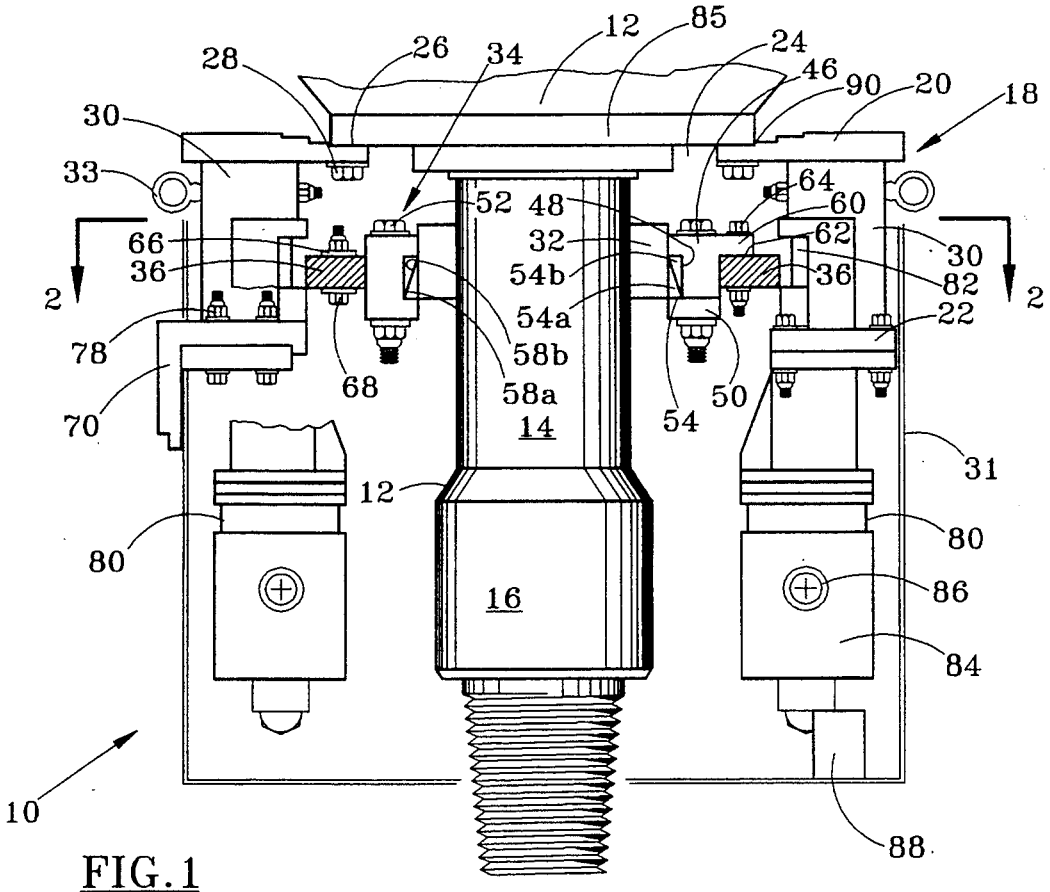
FIG. 1 shows an elevation view partially cut-away of the kelly spinner of the present invention installed on the swivel stem.
Figure 2:
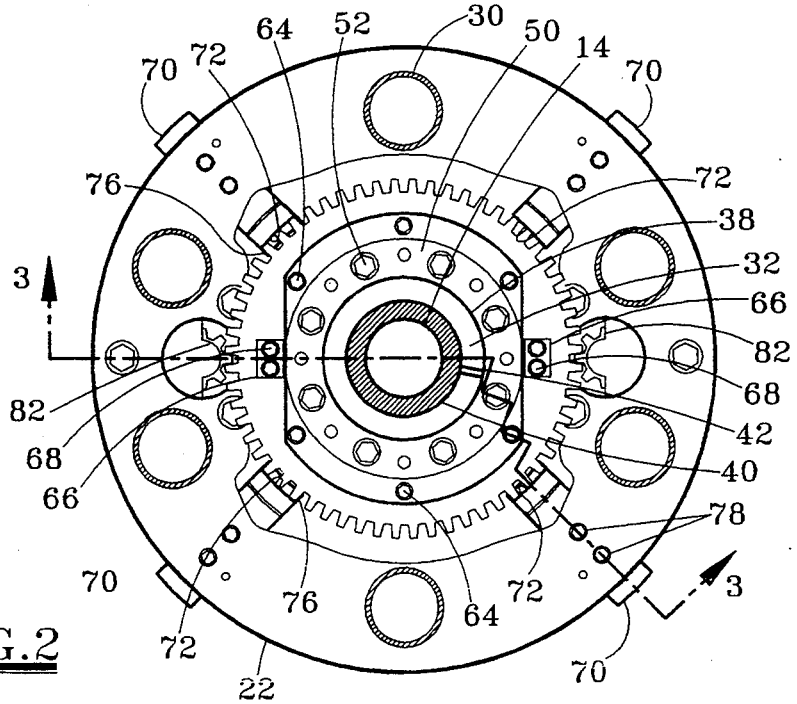
FIG. 2 shows a plan view of the kelly spinner of FIG. 1 taken along the lines 2—2.
Figure 3:
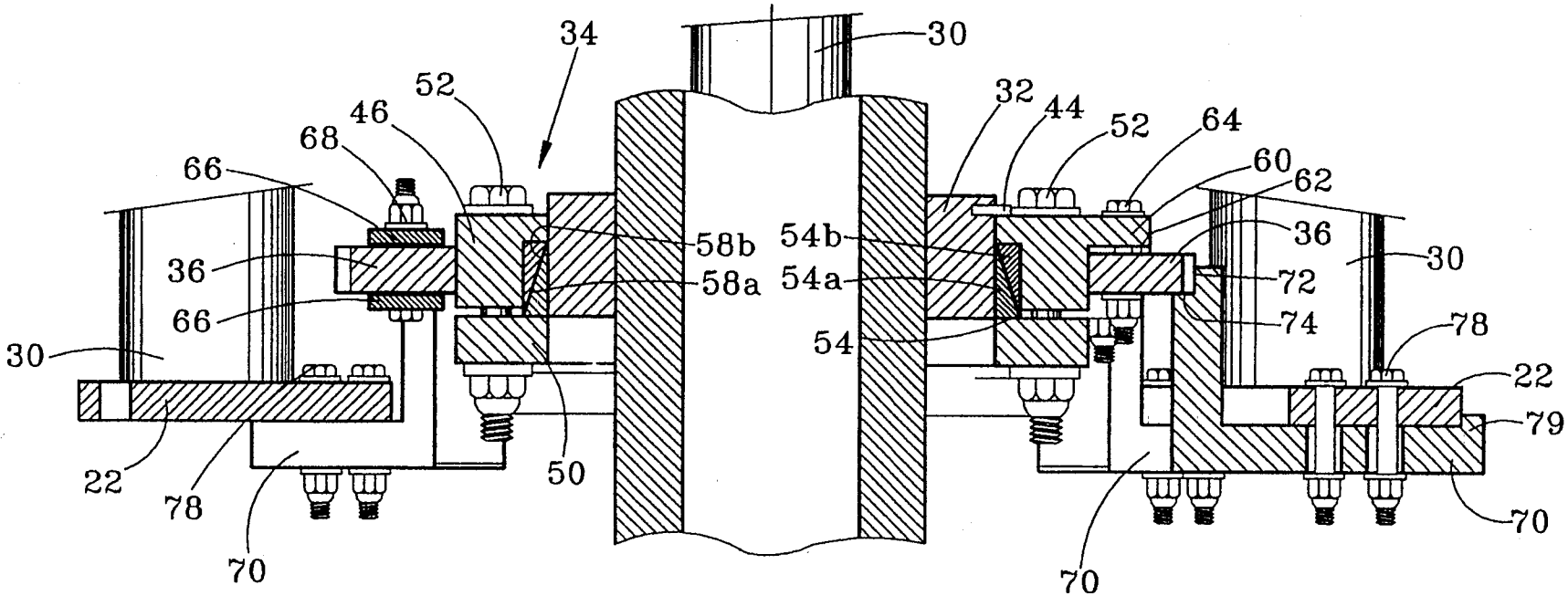
FIG. 3 shows an enlarged, axial cross-sectional view of the kell/spinner of FIG. 2 taken along the lines 3—3 showing the adjustable sleeve and associated clamp.

Referring to FIGS. 1–3 wherein like numerals reference like parts, a kelly spinner 10 is installed on a derrick swivel 12. As is well known in the art, the swivel includes a stem member 14 rotating freely about a swivel joint (not shown) and a sub member 16 attached to the stem member 14 by a threaded pipe fitting (not shown).

The spinner 10 comprises a generally cylindrical housing 18 having an upper flange plate 20, a lower support plate 22 and a central opening 24 receiving the downwardly depending swivel stem 14. The upper plate 20 is fixedly attached to a lower flange surface 26 of the swivel 12 by a circle of bolts 28. A plurality of tubular struts 30 which attach the upper plate 20 to the lower plate 22 depend downwardly from the upper plate 20. The number and size of the struts 30 should be adequate to provide mechanical support for the housing 18 and leave sufficient space for the spinner internal members. Typically 4 to 6 struts can be used. The housing 18 preferably includes a cover 31 for protecting internal components from the meteorological elements. The struts 30 and/or the upper plate 20 can have attached eyebolts 33 for lifting the kelly spinner 10 during installation thereof.

According to the present invention, an adjustable sleeve 32 is compressed about the swivel stem 14 by a clamp assembly 34 in order to securely attach a ring gear 36 to the stem 14. As best seen in FIG. 2, the sleeve 32 has an outer diameter 38, an inner diameter 40 and a longitudinal gap 42. It can be seen that application of a compressive force reduces the sleeve diameter 40 and width of the gap 42. The sleeve includes a plurality of radially-spaced stop pins 44 transversely secured in the sleeve outer diâmeter 38 to inhibit axial movement between the sleeve 32 and the clamp assembly 34.

The clamp assembly 34 is cylindrical, suitable for compressing the sleeve 32 by imposing a compressive radial force and disposed about the sleeve outer diameter 38. Clamp assembly 34 in which tightening in the axial direction translates into a corresponding reduction in diameter is preferred, thus providing the compressive radial force on the sleeve 32. The clamp assembly 34 includes a cylindrical upper hub member 46, which forms an annular slot 48 adjacent the sleeve outer diameter 38, and a lower flange 50. The upper hub member 46 is attached to the lower flange 50 by a plurality of bolts 52 radially spaced in a conventional bolt circle.

A locking ring assembly ,54 made up of axially split c-shaped rings 54*a*, 54*b* having adjacent complementary angled axial surfaces 58*a*, 58*b* is disposed in the annular slot 48. The locking rings have a gap (not shown) which becomes reduced in size as the rings are compressed. The axial surfaces 58*a*, 58*b* extend obliquely from an upper end of an inside diameter to a lower end of an outside diameter. Thus, a tightly clamped connection is made by reducing the axial length of the ring member 54 by closing the clamp 34 (i.e. bolting the hub 46 to the flange 50) and compressing the sleeve 32 as the split rings 54*a*, 54*b* slide in opposing directions along the plane of the angled surfaces 58*a*, 58*b*.

The hub 46 includes an outer shoulder 60 having an annular flange surface 62 for attachment of the ring gear 36. Thus, the ring gear 36 is securely attached to the hub 46 by a plurality of radially-spaced bolts 64. The ring gear 36 is preferably split into dual radial sections (not shown) which are joined by connecting plates 66 and bolts 68. The use of split sections enables the ring gear 36 to be installed and/or removed as necessary without disassembly of the swivel stem 14 and sub 16.

The ring gear 36 is rotated by engagement of a motor 80 having an intermeshing pinion gear 82. The motor can be powered by any means known in the art including hydraulic pressure, air pressure and electricity. Hydraulic powered motors are preferred for reliability and non-sparking operation. Dual opposing hydraulic motors 80 are conveniently used. The motors 80 are secured to the housing bottom flange 16 by bolts 83. The motors 80 have a hydraulic drive 84 with fluid inlet and outlet ports 86, 88.

In the practice of the present invention, the ring gear 36 and the housing 18 should be concentrically aligned to ensure proper operation of the spinner 10, i.e. interengagement between ring gear 36 and the teeth of the gears 82 of the motor 80, which will be mounted on the housing 18. For this end, a plurality of radially-spaced gauge members 70 are provided. The gauges 70 have precisely specified predetermined dimensions to establish the desired radial alignment between the lower plate 22 and the ring gear. A gauge surface 72 of a shoulder 74 at a guide end 76 of the guide 70 is dimensioned to abut the outside diameter of the ring gear 36 adjacent a lower end thereof in the desired position relative to the plate 22 when the gauge 70 is positionally fixed to the plate 22 by means of bolts 78 and outer, upwardly extending lip 79 in engagement with an outer diameter of the plate 22 (see FIGS. 2 and 3). During spinner installation, the gauge members 70 are securely affixed to the lower plate 22 of the housing 18 by bolts 78 so that the ring gear 36 is securely held in the groove 74. After the housing 18 is attached to the swivel 12, with the lower plate 22 properly positioned with respect to the ring gear 36, the gauges 70 are preferably moved away from the ring gear 36 so as to not impede gear rotation. The gauge members 70 are preferably unbolted, turned 180° then rebolted to the lower plate 22 (see FIG. 1 ).

To install the spinner 10, the kelly (not shown) is lowered through the rotary table master bushing (not shown) to lower the swivel to a convenient working height. If necessary, the sub 16 is disconnected from the swivel stem 14. The stem 14 is placed through the center of the adapter sleeve 32 with the stop pins 44 on top as far as possible so that the sleeve rides high thereon. The sub 16 is then reconnected to the swivel stem 14 to the proper torque, and disconnected at its lower end.

With the spinner housing 18 on the drill platform, the gauges 70 are positioned on the housing lower plate 22 as shown in FIGS. 2 and 3 with the bolts 78 still loose, and the ring gear 36 (assembled to the clamp 34) is positioned on the shoulders 74 of gauges 70. The bolts 78 holding the gauges 70 are tightened with the lip 79 in abutment with the outside diameter of the plate 22 to secure the ring gear 36 in proper position with respect to the housing 18. Using the housing eyebolts 33, the housing 18 is hoisted in a level position so that the swivel stem 14 passes through the housing central opening 24, until the sleeve 32 and clamp hub 46 are aligned adjacent the sleeve pins 44. Typically, the pins 44 will rest on the top surface of the hub 46. The flange surface 26 of the upper housing plate 20 is lined up with an equivalent flange surface of the swivel 12 and the housing 18 is bolted to a swivel attachment flange 85 making sure to orient the motor bolts 83 preferably at a right angle to the rotary hose (not shown) to ensure easy access thereto for maintenance purposes. The upper plate 20 preferably has a shoulders 90 to receive the outside diameter of the swivel attachment flange 85 to ensure proper engagement. The swivel bolts 28 are first hand tightened then torqued to a force on the order of 165 ft-lbs.

With the pins 44 still resting on the hub 46, the clamp bolts 52 are tightened first to halt torque (e.g. 35 ft-lb) then to full torque (75 ft-lb). After checking bolts 52 to make sure that none of them will turn at full torque, the gauge bolts 78 are loosened and the gauges 70 withdrawn. The gauges 70 are preferably turned 180° counterclockwise then rebolted to the lower plate 22. The ring gear 36 is preferably checked for run-out and/or wobble with a dial indicator riding on the outside diameter of the hub 46. Allowable run-out should preferably not exceed 0.005 total indicator run-out.

The lower end of the sub 16 can be reconnected, the motors 80 bolted to the lower plate 22 and the pinion gear 82 aligned with the ring gear 36. The motor bolts 83 are torqued, e.g. to 150 ft-lb, and then the swivel stem 14 is turned to check gear alignment. With the motor pinion gear 82 disengaged, the ring gear bottom should preferably not be closer that $\frac{1}{8}$ inch from the top of the motor pinions 82. The pinions 82 are engaged and rechecked for excessive tightness or binding between gears. The cover 31 is installed over the housing 18.

The clamping mechanism of the present invention can secure the ring gear 36 to the stem 14 via the hub 46, locking assembly 34, and sleeve 32, at about the same axial positions so that the attachment is not offset axially as was the case with the prior art kelly spinners that attached directly to the swivel stem. The connection is much more solid, or stiffer, greatly facilitating initial alignment during installation and inhibiting axial movement, wobbling and/or other tendencies for misalignment.

The present kelly spinner is illustrated by way of the foregoing description. The foregoing description is intended as a non-limiting illustration, since many variations will become apparent to those skilled in the art in view thereof. It is intended that all such variations within the scope and spirit of the appended claims be embraced thereby.

I claim:

1. A kelly spinner, comprising:

a generally cylindrical housing having a central opening;

an adjustable sleeve concentric with the central opening receiving a stem of a derrick swivel, the sleeve having an outer diameter surface with axial stops affixed thereto;

a clamp disposed adjacent the sleeve outer diameter surface in abutment with the axial stops, the clamp including a hub member and an associated flange member for locking the sleeve to the swivel stem;

a generally cylindrical locking ring assembly disposed in an annular slot formed between the outer diameter surface of the sleeve, the flange member and the hub member, the ring assembly including dual axially-split ring members having complementary axially angled surfaces;

a ring gear attached to the clamp; and a drive gear mounted in rotational engagement with the ring gear.

2. The spinner of claim 1, including a plurality of radially spaced gauge members removably attached to the housing, the gauge members having a shoulder at an inside end for aligning the ring gear relative to the housing.

3. The spinner of claim 1, wherein the housing includes an upper flange plate for attachment to the derrick swivel.

4. The spinner of claim 1, wherein a motor is mounted to the housing at a lower flange plate to power the drive gear.

5. The spinner of claim 1, including a pair of opposed drive gears adapted for rotating the ring gear in either direction.

6. The spinner of claim 1, wherein the ring gear is a split ring gear assembly.

7. The spinner of claim 1, wherein the ring gear is axially aligned with the sleeve and the locking ring assembly.

8. The spinner of claim 7, wherein the sleeve has an outside diameter in engagement with an outside diameter of the stem.

9. The spinner of claim 8, wherein the sleeve has a longitudinal gap to allow radial compression to reduce the diameter of the sleeve.

10. A method for installing a kelly spinner on a swivel stem, connected to a sub, comprising the steps of: disconnecting the stem from the sub;

sliding a sleeve up the stem, the sleeve having an inside diameter slightly larger than an outside diameter of the stem, a longitudinal gap to allow radial compression to reduce the inside diameter of the sleeve to the outside diameter of the stem, and a plurality of axial stops on an outside diameter of the sleeve adjacent an upper end thereof;

reconnecting the sub to the stem;

positioning a ring gear assembly on a housing with a plurality of radially spaced gauges removably affixed to the housing, the gauges having inner and outer ends, the inner end including an upper shoulder with an annular surface for axially positioning a lower end of the ring gear resting thereon and a longitudinal surface extending upwardly from the annular surface for radially positioning an outside diameter of teeth on the ring gear, the outer end adapted for securing the gauge in a predetermined position with respect to the housing;

wherein the ring gear is circumferentially mounted on an annular clamp assembly comprising a hub member an associated flange member and a locking ring assembly comprising dual axially-split ring members having complementary angled oblique surfaces disposed in an annular slot;

raising the housing to the swivel with the ring gear positioned thereon to slide over the sub and loosely receive the sleeve in the annular clamp assembly;

securing the housing to the swivel in positionally fixed relation thereto in alignment with the swivel stem with the stops on the sleeve in abutment with an upper end of the clamp assembly;

substantially evenly compressing the locking ring assembly axially between the hub member and the flange member to radially compress the sleeve to lock the sleeve into tight engagement with the stem while maintaining the positioning of the ring gear relative to the housing;

removing the gauges;

positioning drive gears in engagement with the ring gear for rotation of the spinner.

11. The method of claim 10, comprising the steps of, after removing the gauges, securing the gauges to the housing in a storage position.

12. The method of claim 10, wherein the ring gear, hub, locking ring assembly and sleeve are disposed concentrically at about the same axial position.

* * * * *